US006619919B2

(12) United States Patent
Kerr, Jr.

(10) Patent No.: US 6,619,919 B2
(45) Date of Patent: Sep. 16, 2003

(54) SAFETY HOOK

(75) Inventor: Jack Russell Kerr, Jr., College Station, TX (US)

(73) Assignee: Angelo Fan Brace Licensing, LLC, Philadelphia, PA (US)

( * ) Notice: Subject to any disclaimer, the term of this patent is extended or adjusted under 35 U.S.C. 154(b) by 0 days.

(21) Appl. No.: 10/067,008

(22) Filed: Feb. 4, 2002

(65) Prior Publication Data

US 2003/0147749 A1 Aug. 7, 2003

(51) Int. Cl.[7] ..... F04D 29/64
(52) U.S. Cl. ..... 416/5; 416/244 R; 24/546
(58) Field of Search ..... 416/5, 244 R; 24/546, 563, 67.9, 908, 599.6

(56) References Cited

U.S. PATENT DOCUMENTS 4,428,032 A * 1/1984 Workman ..... 362/96
4,745,663 A * 5/1988 Crowson ..... 24/131 R
4,777,949 A * 10/1988 Perlin ..... 128/325
5,542,819 A * 8/1996 Bucher et al. ..... 416/146 R
5,937,073 A * 8/1999 Van Gieson ..... 381/391
5,971,573 A * 10/1999 Bucher et al. ..... 362/438
6,122,806 A * 9/2000 Umezawa et al. ..... 24/598.6
6,402,113 B1 * 6/2002 Chang ..... 248/340
6,536,926 B2 * 3/2003 Bucher et al. ..... 362/438

* cited by examiner

*Primary Examiner*—Edward K. Look
*Assistant Examiner*—J. M McAleenan
(74) *Attorney, Agent, or Firm*—Drinker Biddle & Reath LLP

(57) ABSTRACT

A ceiling fan or light fixture is provided with a sliding support member that slides horizontally into a support channel attached to a ceiling box. An electrical plug and receptacle attached to the two support members automatically mate as the two support members are slid together. A bell is then raised to cover the two support members and prevent them from sliding apart.

21 Claims, 2 Drawing Sheets

SAFETY HOOK

FIELD OF THE INVENTION

The invention relates to electrical fixtures, and especially to the overhead mounting of lighting fixtures, fans, and the like.

BACKGROUND OF THE INVENTION

Ceiling fans, pendant ceiling lamps, and the like are commonly mounted by screwing a mounting bracket or the like, attached to the fixture, to an electrical junction box set into the ceiling, which is in turn screwed to a ceiling joist or other structural member of the building. However, even if the ceiling junction box is of a sort designed and approved for the mounting of fans and other heavy fixtures, and the installation is competently installed, there is always a risk of a failure resulting in the fan or light fixture falling from the ceiling. Especially in the case of a large, heavy fan or chandelier, this may present a risk of injury to persons or damage to property underneath.

It is therefore sometimes considered desirable, and in some jurisdictions is required, to provide an alternative means of attaching the weight of the fixture to the ceiling, which bypasses the electrical box and the ceiling bracket attached to it. It has previously been proposed to achieve this by means of a tether, typically a length of wire rope, attached to the fixture, and with a loop at one end that is placed over a hook set directly into the ceiling joist through the top of the ceiling box. Thus, if the ceiling box or the bracket fails, or if the bracket is not properly attached to the ceiling box, the wire rope tethers the fixture to the ceiling. It is not necessary for the wire rope to be taut in the installed configuration. Indeed, it is probably desirable that when the fixture is hanging from the wire rope tether it drop far enough below its usual position for it to be conspicuous that the fixture is not properly mounted.

However, it has been found in practice that the loop on the tether sometimes slips off the hook while the fixture is being installed. The fact that the tether is or becomes slack when the fixture is placed in its installed position facilitates this tendency.

SUMMARY OF THE INVENTION

It is an object of the invention to attach the tether to the ceiling in such a manner that it is less likely to become detached.

In one aspect, the invention provides a hook for attaching a tether to a ceiling joist. The hook consists essentially of a length of bent wire. The hook defines a first loop adapted to lie flat against the inside of a ceiling box, or other flat surface, and to be attached to a ceiling joist through the ceiling box by a screw, the head of which bears on the sides of the first loop. The hook defines a second loop, adapted to extend downwards from the flat surface against which the first loop is screwed, and to hold the tether. One of the free ends of the length of wire extends across the second loop, so as to permit the loop of the tether to be attached to the hook but hinder it from disengaging. That free end is bent round the far side of the second loop, in such a way that if the hook tends to deform under the weight of a fixture hanging from the second loop the free end will tend to tighten on the second loop, reducing the risk that the hook will unbend and release the tether.

The one free end may be adjacent to the part of the wire forming the first loop, and may be placed across the second loop, on the side of the second loop towards the first loop, with the tip angled away from the first loop.

The one free end may be adjacent to the part of the wire forming the second loop, and may be wound loosely round the second loop, so that the tether can be hung onto the second loop by sliding it round the curve of the one free end.

In another aspect, the invention provides a ceiling-mounted electrical box provided with a safety hook according to the invention.

In a further aspect, the invention provides a ceiling-mountable electrical device, and a mounting assembly for suspended electrical devices, such as ceiling mounted lights and fans. A lower support is attached to the device, and includes a flexible tether with a looped end. An upper support is attached to the ceiling, and includes a safety hook according to the invention attached to the ceiling. The lower support is attached to the upper support. The looped end of the tether is hooked onto the safety hook. If the lower support becomes detached from the upper support, the safety hook and tether can still support the electrical device.

BRIEF DESCRIPTION OF THE DRAWINGS

For purposes of illustrating the invention, the drawings show forms in which the invention can be embodied. The invention is not, however, limited to the precise forms shown unless such limitation is expressly made in a claim. In the drawings:

DETAILED DESCRIPTION OF THE DRAWINGS

Figure 1:
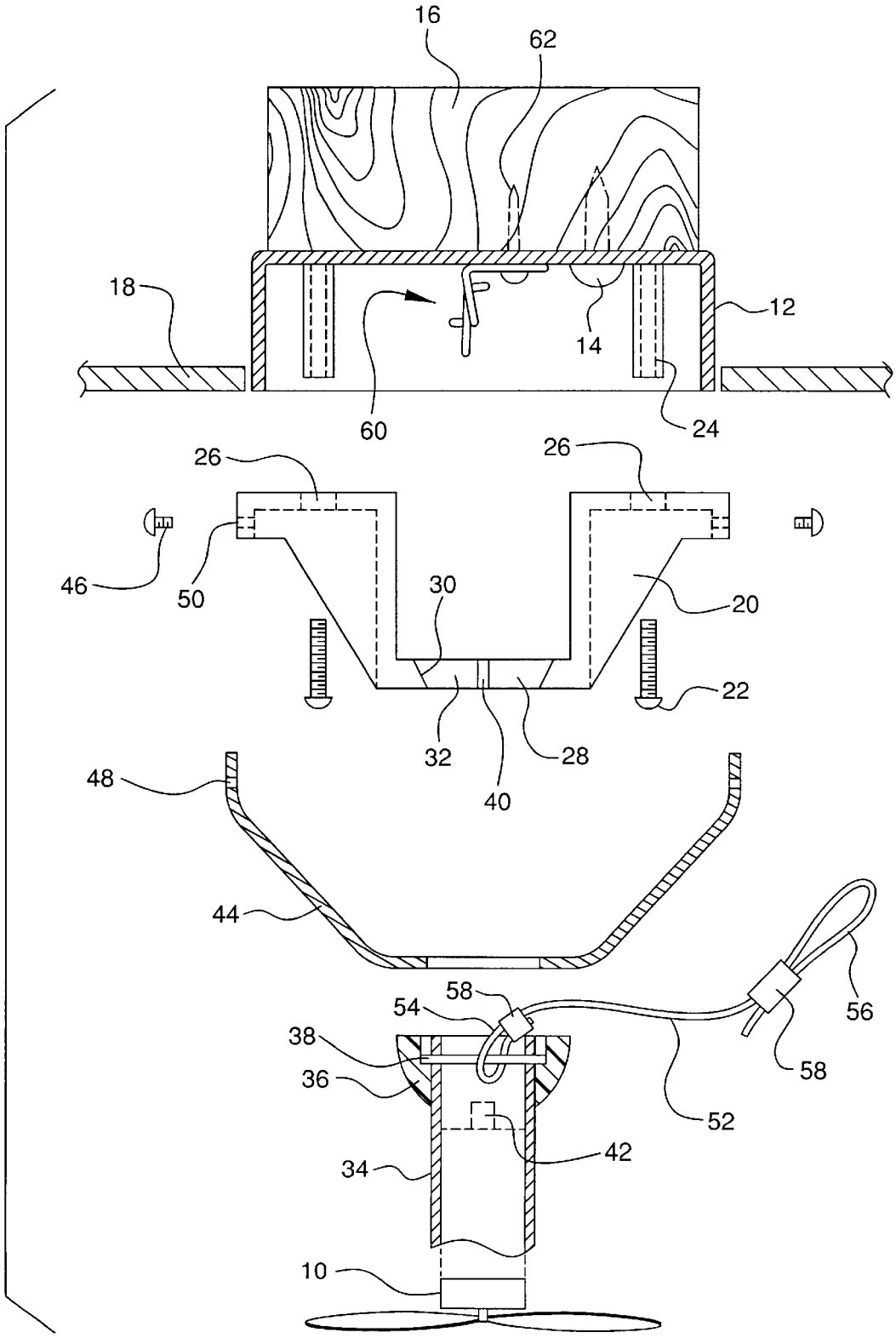
FIG. 1 is a somewhat schematic exploded side view of one embodiment of a ceiling fan and its ceiling attachment, including one form of safety hook according to the invention.

Referring to the drawings and initially to FIG. 1, one form of mounting for a ceiling fan 10 comprises an electrical ceiling box 12 attached by screws 14 to a joist 16, and set flush with the surface of a ceiling 18. A mounting bracket 20 is attached by screws 22 to internally-threaded posts 24, which are positioned within the ceiling box 12 and are fixed to the inside of the box by welding, riveting, or other means. The screws 22 pass through slots 26 in the bracket 20, allowing a single bracket 20 to fit a range of sizes and shapes of ceiling box 12. In the bottom of the bracket 20 is a supporting ring 28, with a beveled bearing surface 30 and a substantial gap 32, occupying about a quarter of the circumference of the ring, in one side.

The fan 10 is attached to a downshaft 34, which has at its top end a ball mount 36. The ball mount 36 is sized to rest on the beveled surface 30 of the supporting ring 28. The diameter of the downshaft 34 will pass through the gap 32 in the supporting ring 28, but only if the ball mount 36 is lifted off the beveled surface 30. A bar 38 passes diametrically across the downshaft 34, and at both ends extends through the wall of the downshaft 34, and into notches in the ball mount 36.

The ball mount 36 and the beveled surface 30 act as a bearing allowing the downshaft 34, and thus the fan 10, to swing slightly, and to hang vertically even if the ceiling 18 is not perfectly horizontal. The downshaft 34 is prevented from revolving about its axis by a key 40 on the beveled surface 30, which engages loosely in a slot 42 in the ball mount 36.

A bell or canopy 44 fits over and conceals the bracket 20 and the ball mount 36. The bell 40 would normally be slid onto the downshaft 34 before the fan 10 is attached, or before the ball mount 36 is attached, and would thereafter be captive. When the mounting is assembled, the bell 44 is placed snug against the ceiling 18 and is retained by screws 46 passing through holes 48 in the bell into holes 50 in the bracket 20.

When the mounting is fully assembled, the weight of the fan 10 is transmitted by the downshaft 34 to the bar 38, the ball mount 36, the bracket 20, the screws 22, the threaded posts 24, the electrical ceiling box 12, the screws 14, and the joist 16, in that order. A structural failure, or a defective connection, anywhere along that chain may result in the fan falling from the ceiling. The bell 44 provides extra security for the ball mount 36, and mounting ring 28, but not for other parts of the chain. In any case, the bell 44 is not designed as a structural component, and may not be strong enough to bear the load if the ball mount becomes separated from the mounting ring.

A tether 52 is therefore provided. The tether 52 consists of a length of wire rope, with each end formed into a loop 54, 56 by crimped-sleeve clamps 58 or other convenient means.

The lower loop 54 of the tether 52 is captive on the bar 38. When the mounting is assembled, the upper loop 56 of the tether 52 is hung on a hook indicated generally by the reference numeral 60, which is attached directly to the joist 16 by a screw 62. Although the screw 62 is shown in FIG. 1 as passing through the base of the electrical box 12, it will be appreciated that the hook 60 may instead be positioned within a larger opening in the box 12. For example, the electrical box 12 may be a multi-purpose junction box, with easily-removed blanking plates for cable entryways in all five sides. The hook 60 may then be designed to fit into the circular space left if such a blanking plate in the base of the box is removed. The hook 60 may then remain secure even if the box 12 is torn from the ceiling.

Figure 2:
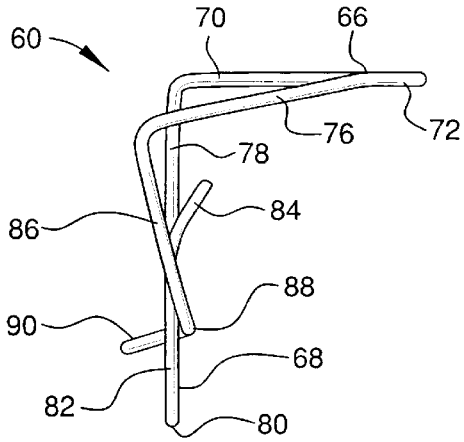
FIG. 2 is an enlarged side elevation view of the safety hook shown in FIG. 1.
Figure 3:
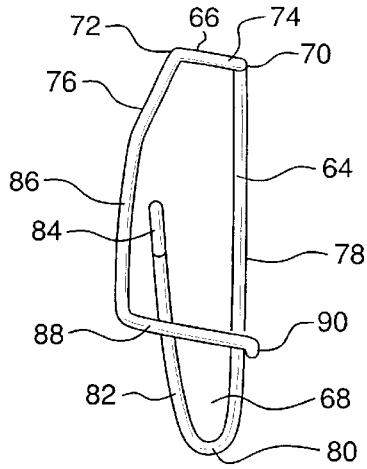
FIG. 3 is a rear elevation view of the safety hook shown in FIG. 2.
Figure 4:
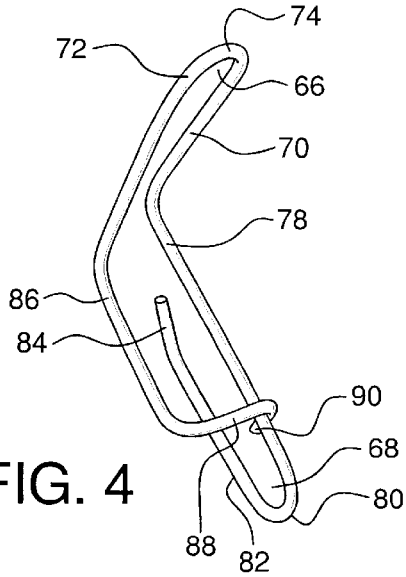
FIG. 4 is a perspective view from below of the safety hook shown in FIG. 2.

Referring now to FIGS. 2 to 4, the safety hook 60 consists of a piece of wire 64 bent into a particular shape. The hook 60 has a first loop 66, intended to be secured to the joist 16 by the screw 62, and a second loop 68, intended to hold the upper loop 56 of the wire rope tether 52. For simplicity, the safety hook 60 is described in terms of its orientation when the first loop 66 is flat against a horizontal ceiling and the second loop is at the front. It will be understood, however, that the safety hook 60 is not limited to that orientation. The first loop 66 is defined by two straight, roughly parallel, sections 70 and 72 about 5 mm (¼") apart, joined at their rear ends by a semicircular section 74. The straight section 70 is about 25 mm (1") long. The straight section 72 is only about 10 mm long, and merges into a straight section 76, about 20 mm long, that angles down at about 10°. The front end of the straight section 76 thus projects slightly beyond the front end of the straight section 70, as best seen in FIG. 2.

From the front end of the straight section 70, a straight section 78, about 40 mm long, extends vertically downwards. The straight section 78 leads into a semicircular section 80, from the other end of which a straight section 82 about 20 mm long extends vertically upwards. The sections 78, 80, and 82 together form the second loop 68. The straight section 78 forms a bight portion joining the first and second loops 66 and 68. The straight section 82 is on the same side of the straight section 78 as the straight sections 72 and 76 are of the straight section 70. If the straight section 82 were extended, it would meet the straight section 76 a few millimeters short of the far end of the latter. Instead, the straight section 82 ends in a short section 84 that is angled rearwards, towards the first loop 66, and has a free end.

From the front end of the straight section 76, a straight section 86, about 25 mm long, extends roughly perpendicularly, downwards and angled a little backwards. As is best seen in FIG. 3, the straight sections 76 and/or 86 are angled a little sideways, so that the bottom end of the straight section 86 is spaced a few millimeters sideways away from the second loop 68, outside the straight section 82. From the bottom end of the straight section 86, a straight section 88 extends roughly horizontally across, and presses lightly against, the back of the second loop 68. The straight section 88 ends in a short section 90, with a free end, extending forwards at the outside of the straight section 78.

The diameters of the semicircular sections 74 and 80 are selected to accommodate the screw 62 and the upper loop 56 of the tether 52, respectively. As shown in FIGS. 2 to 4, they are each about 5 mm in diameter. Although in FIG. 1 the safety hook 60 is shown as being retained directly by the head of the screw 62, a washer may be placed under the head of the screw. The matching of the size of the first loop 66 to the size of the screw 62 is then less critical. The sharpness of the other bends is not believed to be important. Those skilled in the art will understand how to select a suitable radius for a particular wire that will provide a clean bend without unduly straining the material.

Referring again to FIG. 1, the safety hook 60 is screwed to the joist 16 by a screw 62 through the first loop 66, after the ceiling box 12 is installed but before the installation of the fan 10 commences. During installation of the fan, the installer slips the upper loop 56 of the tether 52 over the free end section 84 from the front of the safety hook 60 (the left side as seen in FIG. 2). By pulling forward slightly, the straight section 82 can be lifted away from the horizontal section 88, allowing the upper loop 56 of the tether 52 to be slid down into the second loop 68 of the safety hook 60. The tether is then retained in the second loop 68, by the horizontal section 88 resting against the sections 78 and 82 and closing the top of the loop 68.

If for any reason the fan 10 ceases to be supported by the bracket 20, it will drop until the tether 52 becomes taut, supporting the bar 38 from the safety hook 60. The load imposed on the safety hook 60 is then transmitted through the vertical section or bight portion 78 and the horizontal section 70 to the screw 62. If the safety hook 60 tends to deform under the weight of the fan 10, it will deform by bending of the horizontal straight section 70. As may be seen from FIG. 2, this will result in the bight portion 78 and the second loop 68 moving downwards and backwards, and pressing more firmly against the horizontal section 88 and the free end section 90. If the section 70 deforms far enough, the angle between the sections 82 and 84 will engage the horizontal section 88. Thus, not only is the tether 52 retained against slipping off the safety hook 60 while the fan is being installed, it is actually retained more firmly if it comes into use.

Figure 5:
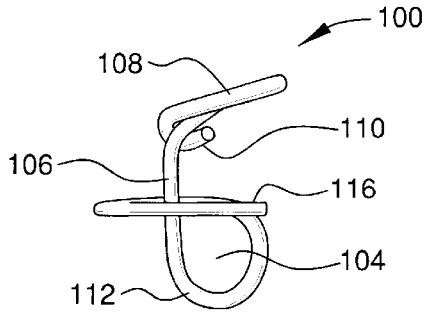
FIG. 5 is an enlarged side elevation view of a second embodiment of safety hook.
Figure 6:
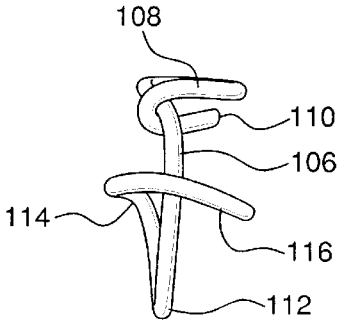
FIG. 6 is a front elevation view of the safety hook shown in FIG. 5.
Figure 7:
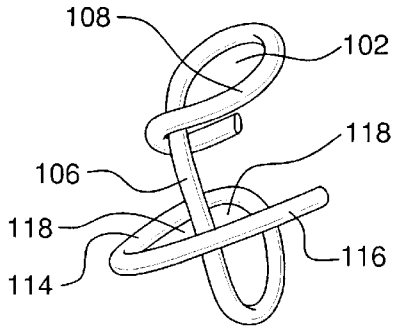
FIG. 7 is a perspective view from above of the safety hook shown in FIG. 5.

Referring now to FIGS. 5 to 7, the second form of safety hook, indicated generally by the reference numeral 100, has a first loop 102 to receive the screw 62 and a second loop 104 to receive the upper loop 56 of the tether 52. The safety hook 100 is smaller than the first safety hook 100, and is about 25 mm (1") in its longest dimension, approximately the vertical direction in FIG. 7.

At the middle of the safety hook 100 is a straight, roughly upright, section or bight portion 106. At the top of the bight portion 106 is a section 108 bent approximately into a circle to form the first loop 102. The section 108 ends in a free end section 110 that is doubled back round the upper end of the straight section 106. The free end section 110 is clinched tightly round the bight portion 106, to form the circular section 108 into a substantially closed ring.

At the bottom of the upright section 106 is a curved section 112 forming the second loop. The curved section 112 leads into a roughly horizontal section 114 that crosses to one side of the upright section or bight portion 106, and doubles back into a free end section 116 that crosses to the other side of the upright section 106. The sections 114 and 116 are not clinched tightly round the upright section 106. Preferably, the gap 118 between the upright section 106 and each of the sections 114 and 116 is narrower than the thickness of the wire rope forming the tether 52, but is wider than half that thickness.

In use, the hook 100 is fastened to the joist 16 by a screw 62 through the loop 102, with the head of the screw, or a washer under the head of the screw, bearing on the circular section 108. The upper loop 56 of the tether 52 is passed over the free end of the section 116, along the sections 116 and 114, and down onto the curved section 112 forming the second loop 104. Because of the dimensioning of the gaps 118, there is a slight snap action as the tether loop 56 passes the upright section 106 on each of the sections 116 and 114. However, even if the gaps 118 are wide enough that no snap action occurs, the spiraling path from the bottom of the second loop 104 to the free end of the section 116 makes it very unlikely that the tether loop 56 could work its way free from the hook 100 in normal use.

If the fan comes to hang by the tether 52 from the safety hook 100, its weight is transmitted up the vertical section 106. If the safety hook 100 deforms under the weight, it will deform first by unrolling of the loop 112 at the base of the upright section or bight portion 106. As may be seen from FIG. 5, if that happens the angle between the sections 114 and 116 will close onto the bight portion 106, securing the loop 112 against further deformation.

The present invention may be embodied in still further specific forms without departing from the spirit or essential attributes thereof and, accordingly, reference should be made to the appended claims, rather than to the foregoing specification, as indicating the scope of the invention.

What is claimed is:

1. A safety hook, comprising:

an elongate member defining a first loop, adapted to be fastened to a support, a second loop, adapted to receive a looped end of a tether, a bight portion joining the first and second loops, and first and second free ends continuing respectively from the first and second loops;

wherein the second free end is so disposed in the vicinity of another part of the elongate member as to permit a looped end of the tether to be passed over the second free end and onto the second loop, and as to hinder detachment of the looped end of the tether from the second loop; and wherein one said free end is bent round the bight in such a manner that, if the safety hook deforms under tension between the first and second loops, the bight and the said one free end engage so as to tend to prevent opening of the second loop.

2. A safety hook according to claim 1, consisting essentially of said elongate member.

3. A safety hook according to claim 1, wherein said elongate member consists essentially of a length of bent wire.

4. A safety hook according to claim 1, wherein said one free end is the second free end, wherein the elongate member continues from the second loop to form a transverse portion extending across the bight, is doubled back to form the second free end extending across the bight on the opposite side of the bight from said transverse portion, said second free end and said transverse portion being spaced apart from said bight.

5. A safety hook according to claim 1, wherein said one free end is the first free end, and is positioned across the bight and across the elongate member between the second loop and the second free end.

6. A mounting assembly for attaching an appliance to a ceiling, the assembly comprising:

an electrical box attached to the ceiling; and a safety hook within the electrical box, comprising an elongate member defining a first loop, fastened to the ceiling, a second loop, adapted to receive a looped end of a tether, a bight portion joining the first and second loops, and first and second free ends continuing respectively from the first and second loops;

wherein the second free end is so disposed in the vicinity of another part of the elongate member as to permit a looped end of the tether to be passed over the second free end and onto the second loop, and as to hinder detachment of the looped end of the tether from the second loop; and wherein one said free end is bent round the bight in such a manner that, if the safety hook deforms under tension between the first and second loops, the bight and the said one free end engage so as to tend to prevent opening of the second loop.

7. A mounting assembly according to claim 6, wherein said safety hook consists essentially of said elongate member.

8. A mounting assembly according to claim 6, wherein said elongate member consists essentially of a length of bent wire.

9. A mounting assembly according to claim 6, wherein said one free end is the second free end, wherein the elongate member continues from the second loop to form a transverse portion extending across the bight, is doubled back to form the second free end extending across the bight on the opposite side of the bight from said transverse portion, said second free end and said transverse portion being spaced apart from said bight.

10. A mounting assembly according to claim 6, wherein said one free end is the first free end, and is positioned across the bight and across the elongate member between the second loop and the second free end.

11. A mounting system for suspended electrical devices, comprising:

an upper support adapted to be attached to a ceiling;

a lower support adapted to be attached to and to support an electrical device, and adapted to be attached to and to be supported by said upper support member;

a flexible tether having a looped end extending from the lower support; and a safety hook, adapted to be attached to the ceiling and comprising an elongate member defining a first loop, adapted to be fastened to a support, a second loop, adapted to receive a looped end of a tether, a bight portion joining the first and second loops, and first and second free ends continuing respectively from the first and second loops;

wherein the second free end is so disposed in the vicinity of another part of the elongate member as to permit said looped end of the tether to be passed over the second free end and onto the second loop, and as to hinder detachment of said looped end of the tether from the second loop; and wherein one said free end is bent round the bight in such a manner that, if the safety hook deforms under tension between the first and second loops, the bight and said one free end engage so as to tend to prevent opening of the second loop.

12. A mounting system according to claim 11, wherein said safety hook consists essentially of said elongate member.

13. A mounting system according to claim 11, wherein said elongate member consists essentially of a length of bent wire.

14. A mounting system according to claim 11, wherein said one free end is the second free end, wherein the elongate member continues from the second loop to form a transverse portion extending across the bight, is doubled back to form the second free end extending across the bight on the opposite side of the bight from said transverse portion, said second free end and said transverse portion being spaced apart from said bight.

15. A mounting system according to claim 11, wherein said one free end is the first free end, and is positioned across the bight and across the elongate member between the second loop and the second free end.

16. A ceiling-mountable electrical device, comprising:

an upper support adapted to be attached to a ceiling;

a lower support attached to the electrical device, and adapted to be attached to and to be supported by said upper support;

a flexible tether having a looped end extending from the lower support; and a safety hook, adapted to be attached to the ceiling and comprising an elongate member defining a first loop, adapted to be fastened to a support, a second loop, adapted to receive a looped end of a tether, a bight portion joining the first and second loops, and first and second free ends continuing respectively from the first and second loops;

wherein the second free end is so disposed in the vicinity of another part of the elongate member as to permit said looped end of the tether to be passed over the second free end and onto the second loop, and as to hinder detachment of said looped end of the tether from the second loop; and wherein one said free end is bent round the bight in such a manner that, if the safety hook deforms under tension between the first and second loops, the bight and said one free end engage so as to tend to prevent opening of the second loop.

17. A ceiling-mountable electrical device according to claim 16, wherein said safety hook consists essentially of said elongate member.

18. A ceiling-mountable electrical device according to claim 16, wherein said elongate member consists essentially of a length of bent wire.

19. A ceiling-mountable electrical device according to claim 16, wherein said one free end is the second free end, wherein the elongate member continues from the second loop to form a transverse portion extending across the bight, is doubled back to form the second free end extending across the bight on the opposite side of the bight from said transverse portion, said second free end and said transverse portion being spaced apart from said bight.

20. A ceiling-mountable electrical device according to claim 16, wherein said one free end is the first free end, and is positioned across the bight and across the elongate member between the second loop and the second free end.

21. A ceiling-mountable electrical device according to claim 16, which is selected from the group consisting of lights and fans.

* * * * *